United States Patent [19]

Hestilow

[11] Patent Number: 4,844,453

[45] Date of Patent: Jul. 4, 1989

[54] STRETCHING MACHINE

[75] Inventor: Gary P. Hestilow, Oklahoma City, Okla.

[73] Assignee: Century Martial Art Supply, Inc., Midwest City, Okla.

[21] Appl. No.: 170,559

[22] Filed: Mar. 21, 1988

[51] Int. Cl.[4] ..... A63B 21/00

[52] U.S. Cl. ..... 272/126; 272/130; 272/903

[58] Field of Search ..... 272/93, 126, 130, 134, 272/903; 254/93 R, 934

[56] References Cited

U.S. PATENT DOCUMENTS

| | | | |
|---|---|---|---|
| 4,125,258 | 11/1978 | McArthur | 272/903 X |
| 4,277,062 | 7/1981 | Lawrence | 272/126 |
| 4,456,247 | 6/1984 | Ehrenfried | 272/126 |
| 4,479,633 | 10/1984 | McCreery | 254/93 R |
| 4,647,040 | 3/1987 | Ehrenfried | 272/126 |

OTHER PUBLICATIONS

Exhibit A–Photograph showing a leg bar and a leg deck of the prior art stretching machine.

Exhibit B–Photograph showing a leg bar and a leg deck of the prior art stretching machine.

Exhibit C–A brochure of Applicant's assignee showing this prior art stretching machine on the back cover.

Exhibit D–A Photograph showing one version of the prior art stretching machine.

Exhibit E–A Photograph showing another version of the prior art stretching machine.

Exhibit F–A Photograph showing the hydraulic jack utilized with the prior art stretching machine.

*Primary Examiner*—Richard J. Apley

*Assistant Examiner*—Robert W. Bahr

*Attorney, Agent, or Firm*—Dunlap, Codding, Peterson & Lee

[57] ABSTRACT

A stretching machine for stretching the legs of an individual which includes a pair of leg bars and a pair of leg decks. Each leg deck is slidingly and pivotingly connected to one of the leg bars to permit adjustments for different leg lengths of individuals. The leg bars are moveable in a general arc from a rest position to stretch positions by a hydraulic jack comprising a jack base, a base jack rod slidingly disposed in the jack base and a connecting rod disposed in the base jack rod. A linkage connects the connecting rod to the leg bars. A channel is slidingly connected to each leg bar and one end of the a pin is connected to the channel, the opposite end of the pin being pivotally disposed in a pivot opening in the leg deck.

6 Claims, 3 Drawing Sheets

STRETCHING MACHINE

FIELD OF THE INVENTION

The present invention relates generally to stretching machines and, more particularly, but not by way of limitation, to a stretching machine wherein the leg decks are slidingly connected to respective leg bars.

BRIEF DESCRIPTION OF THE DRAWINGS

FIG. 6 is a view of the hydraulic jack portion of the stretching machine of the present invention.

DESCRIPTION OF THE PREFERRED EMBODIMENT

Figure 1:
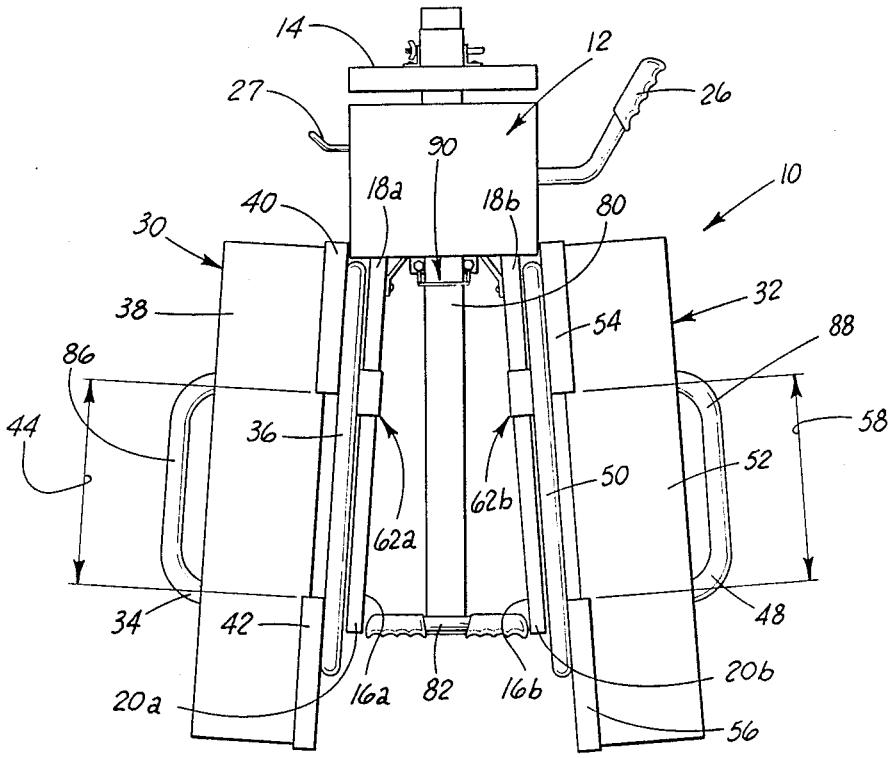
FIG. 1 is a top plan view of a stretching machine constructed in accordance with the present invention with the leg bars and leg decks connected thereto in the rest positions.
Figure 2:
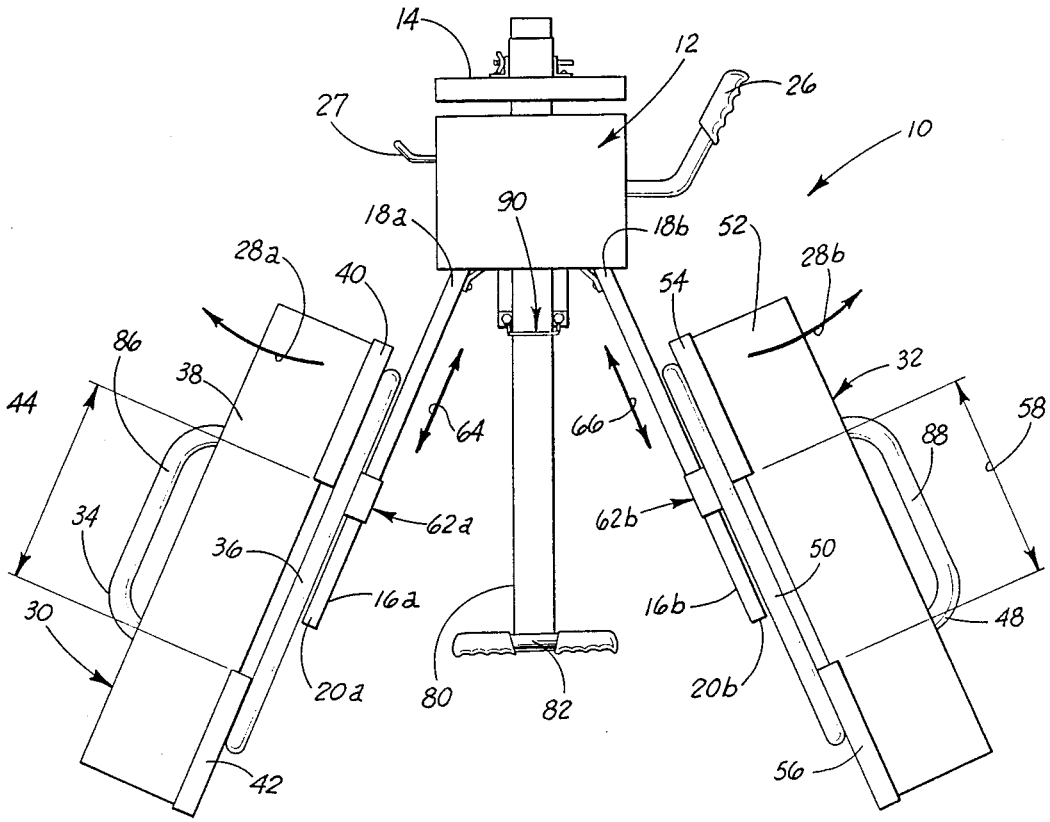
FIG. 2 is a top plan view of the stretching machine of FIG. 1 with the leg bars and the leg decks connected thereto in one stretch position.

Referring to the drawings in general and to FIGS. 1 and 2 in particular shown therein and designated by the general reference numeral 10 is a stretching machine which is constructed in accordance with the present invention.

The stretching machine 10 includes a seat 12 with an adjustable seat back 14 for accommodating an individual setting thereon, and a pair of leg bars 16. The leg bars 16 are identical in construction and the leg bars 16 are designated in FIGS. 1 and 2 by the respective reference numerals 16*a* and 16*b*.

Each of the leg bars 16 has a pivot end 18 and an opposite terminating end 20. The pivot ends 18 and the terminating ends 20 of the respective leg bars 16 are designated in FIGS. 1 and 2 by the respective reference numerals 18*a* and 20*a* and 18*b* and 20*b*.

Figure 5:
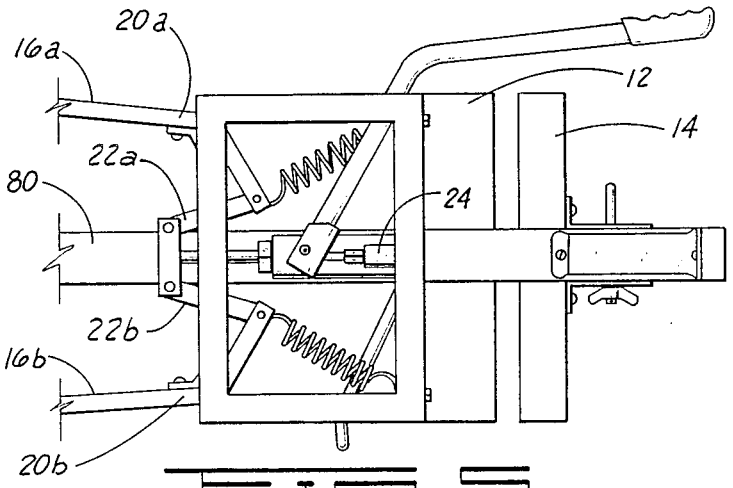
FIG. 5 is a bottom plan view showing a portion of the stretching machine of FIGS. 1 and 2.
Figure 5:
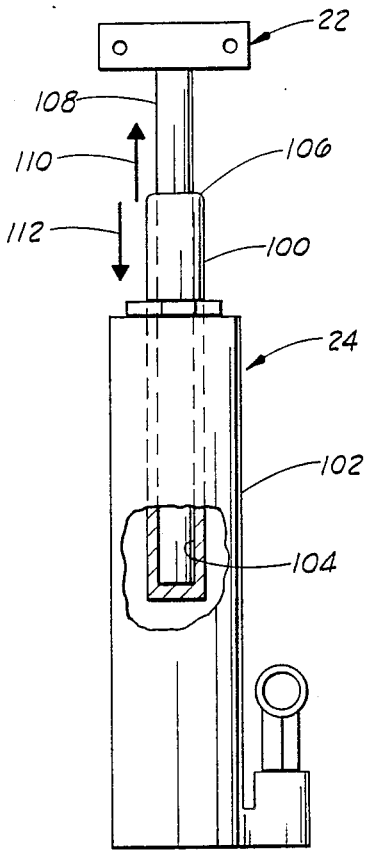

As shown in FIG. 5, the pivot ends 18 of each of the leg bars 16 are connected through a linkage 22 to hydraulic jack 24. The linkages 22 are designated in FIG. 5 by the respective reference numerals 22*a* and 22*b*. The hydraulic jack 24 is operatively connected to a jack handle 26 (shown in FIGS. 1 and 2) so that, by moving the jack handle 26 back-and-forth, the hydraulic jack 24 moves the leg bars 16 from the rest position wherein each leg bar 16 extends a distance from the seat 12 and the leg bars 16 are disposed generally near each other, as shown in FIG. 1, to stretch positions, one stretch position being shown in FIG. 2. In moving the leg bars 16 to the stretch positions, the terminating ends 16*a* and 16*b* are moved in directions 28*a* and 28*b* respectively, (shown in FIG. 2), generally away from each other in a generally arc shaped movement generally about the pivot ends 18*a* and 18*b*.

A release rod 27 (shown in FIGS. 1 and 2) is connected to the hydraulic jack 24 so that an individual can move the release rod 27 to deactivate the hydraulic jack 24 for conditioning the leg bars 16 to be moved back to the rest position.

As shown in FIGS. 1 and 2, the stretching machine 10 also includes a pair of leg decks 30 and 32. The leg decks 30 and 32 are identical in general construction, except the leg deck 30 is adapted for connection to the leg bar 16*a* and the leg deck 32 is adapted for connection to the leg bar 16*b*. In other words, the leg deck 30 is adapted to support and engage right leg of the individual and the leg deck 32 is adapted to engage the left leg of the individual.

As shown in FIGS. 1 and 2, the leg deck 30 includes a base frame 34 with a side grip bar 36 connected to the base frame 34 and extending a distance generally upwardly thereform. A leg pad 38 is removably connected to the base frame 34 and the leg pad 38 is adapted and positioned to support portions of the individual's leg during the operation. A thigh pad 40 is connected to the side grip bars 36 and a calf pad 42 also is connected to the side grip bar 36. The thigh pad 40 is spaced a distance 44 from the calf pad 42 so the individual's knee area is disposed generally between the thigh pad 40 and the calf pad 42 during the operation. Wheels (not shown) are connected to the base frame 34 for cooperating to rollingly support the leg deck 30 during the operation.

As shown in FIGS. 1 and 2, the leg deck 32 includes a base frame 48 with a side grip bar 50 connected to the base frame 48 and extending a distance generally upwardly therefrom. A leg pad 52 is removably connected to the base frame 48 and the leg pad 52 is adapted and positioned to support portions of the individual's leg during the operation. A thigh pad 54 is connected to the side grip bar 50 and a calf pad 56 also is connected to the side grip bar 50. The thigh pad 54 is spaced a distance 58 from the calf pad 56 so the individual's knee area is disposed generally between the thigh pad 54 and the calf pad 56 during the operation. Wheels (not shown) are connected to the base frame 48 for cooperating to rollingly support the leg deck 32 during the operation.

Figure 3:
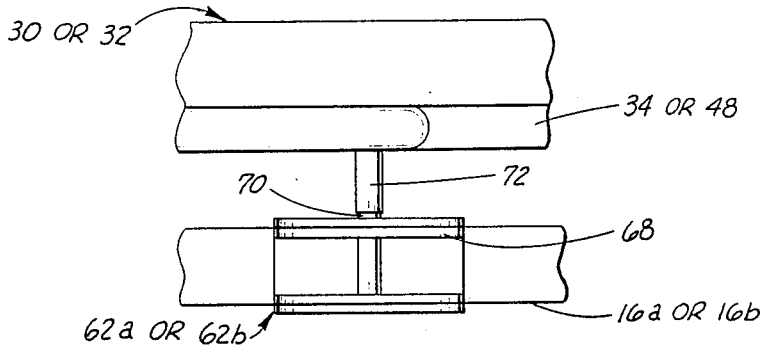
FIG. 3 is a fragmentary view showing a typical slide assembly for slidingly and pivotally connecting the leg decks to the leg bars.
Figure 4:
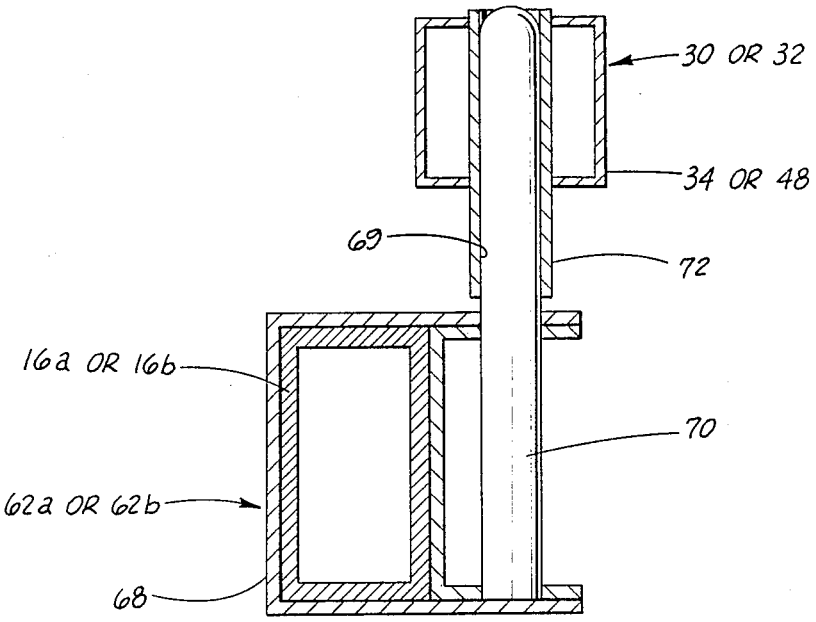
FIG. 4 is a sectional view of a typical slide assembly for slidingly and pivotally connecting the leg decks to the leg bars.

The stretching machine 10 includes a pair of slide assemblies 62, as shown in FIGS. 1 and 2 and as shown in more detail in FIGS. 3 and 4. The slide assemblies 62 are identical in construction and the respective slide assemblies 62 are designated in FIGS. 1 and 2 by the reference numerals 62*a* and 62*b*. The slide channels 62 are adapted for slidingly connecting the leg decks 30 and 32 to the leg bars 16*a* and 16*b*, respectively, to permit sliding adjustments in directions 64 and 66, respectively, generally between the pivot end 18 and the terminating end 20 of the leg bars 16 for accommodating different leg lengths of individuals.

As shown in FIGS. 3 and 4, each slide assembly 62 includes a channel 68 and a pivot pin 70. The channel 68 slidingly mounts on the leg bar 16 for sliding movement in the directions 64 or 66. The pivot pin 70 has opposite ends and one end of the pivot pin 70 is secured to the channel 68 and the pivot pin 70 extends a distance in a generally upwardly direction from the channel 68.

One of the channels 68 is slidingly mounted on the leg bar 16*a* and the other channel 68 is slidingly mounted on the leg bar 16*b*. The pivot pin 70 on the channel 68 mounted on the leg bar 16*a* extends upwardly and is pivotingly disposed through a pivot opening 69 in a rod 72 which is secured to the base frame 34 and for pivotingly connecting the leg deck 30 to the channel 68. The pivot pin 70 on the channel 68 mounted on the leg bar 16*b* extends upwardly and is pivotingly disposed through the pivot opening 69 in the rod 72 which is secured to the base frame 48 for pivotingly connecting the leg deck 32 to the channel 68. The slide assemblies 62 thus cooperate to slidingly and pivotingly connect the leg decks 30 and 32 to the leg bars 16*a* and 16*b* for permitting angular adjustment of the leg decks 30 and 32 to accommodate the angle of the individual's legs with respect to the individual's body in the sitting position.

In operation, the individual sits on the seat 12. With the leg bars 16 and the leg decks 30 and 32 connected thereto in the rest positions, the individual disposes the individual's right leg on the leg pad 38 of the leg deck 30 and the individual disposes the individual's left leg on the leg pad 52 of the leg deck 32. The leg deck 30 is slidingly moved on the leg bar 16*a* and positioned so the thigh pad 40 engages the inside thigh area and the calf pad 42 engages the inside of the calf area with the knee area disposed in the space between the thigh pad 50 and the calf pad 42. The leg deck 30 is pivotally moved to accommodate the indiviudal's leg. The leg deck 32 is slidingly moved on the leg bar 16*b* and positioned so the thigh pad 54 engages the inside thigh area and the calf pad 16 engages the inside calf area with the knee area disposed in the space between the thigh pad 54 and the calf pad 56. The leg deck 32 is pivotally moved to accommodate the individual's leg.

After the individual has been positioned as just described, the individual moves the jack handle 26 back-and-forth thereby causing the leg bars 16*a* and 16*b* to be moved arcuately outwardly in directions 28*a* and 28*b*, respectively, thereby stretching the individual's legs. By moving the release rod 27, the individual conditions the hydraulic jack 24 so the leg bars 16 can be returned to the rest positions.

A bar 80 (shown more clearly in FIGS. 1 and 2) is connected to the seat 12 and extends a distance from the seat 12 with a T-bar 82 connected to the opposite end of the bar 80. Handle grips are disposed on the ends of the T-bar 82. The T-bar 82 and handle grips are positioned for gripping by the individual to aid in front stetches.

The side grip bars 36 and 50 are positioned on the top of the leg decks 30 and 32, respectively, to aid in side stretching exercises. A portion 86 of the base frame 34 is shaped for gripping by the individual to aid in side stretching exercises. A portion 88 of the base frame 48 is shaped for gripping by the individual to aid in side stretching exercises.

A reference scale indicator 90 is disposed over the bar 80 and indicia are included on the upper surface of the bar 80. The scale indicator 90 is operatively connected to the leg bars 16*a* and 16*b* so the scale indicator 90 is moved as the leg bars 16*a* and 16*b* are moved to stretch positions for indicating the angular disposition of the leg bars 16*a* and 16*b*.

A wheel (not shown) is connected to the terminating end 20*a* portion of the leg bar 16*a* for rolling supporting the leg bar 16*a* during the movement of the leg bar 16*a* to stetch positions. Wheel (not shown) is connected to the terminating end 20*b* of the leg bar 16*b* for rolling supporting the leg bar 16*b* during the movement of the leg bar 16*b* to stretch positions.

The hydraulic jack 24 is shown in greater detail in FIG. 6. The hydraulic jack 24 includes a base jack rod 100 which is slidingly disposed in a jack base 102. The base jack rod 100 has an opening 104 which intersects an upper end 106 and extends a distance through the base jack rod 100. A cylinderically shaped connecting rod 108 is disposed in the opening 104 in the base jack rod 100 with one end of the connecting rod 108 engaging the closed end of the base jack rod 100. The linkage 22*a* is connected to one end of the connecting rod 108.

In operation, as the hydraulic jack 24 is actuated, the base jack rod 100 is moved outwardly in a direction 110 thereby causing the connecting rod 108 to be moved in the direction 110. The movement of the connecting rod 108 in the direction 110 causes the leg bar 16 to be moved outwardly in the manner described before.

If it becomes necessary to replace the hydraulic jack 24 for any reason, the hydraulic jack is deactuated thereby causing the base jack rod 100 to be moved in a direction 112 until the base jack rod 100 is disposed completely within the jack base 102. The leg bars 16 then are moved in the directions 28, thereby causing the connecting rod 108 to be moved in the direction 110 until the connecting rod 108 is completely removed from the base jack rod 100. The hydraulic jack 24 is then disconnected and removed for replacement. With this structure, it is not necessary to unbolt the linkage 22 from the hydraulic jack 24 and the rebolt such linkage 22 to the replacement jack thereby making the replacement of the hydraulic jack 24 a much simplier and less costly operation.

Changes may be made in the construction and the operation of the various components, parts, elements and assemblies described herein without departing from the spirit and the scope of the invention as defined in the following claims.

I claim:

1. A stretching machine for stretching the legs of an individual, comprising:

a seat adapted for accommodating the individual sitting thereon;

a pair of leg bars, each leg bar having a pivot end and an opposite terminating end;

means connected to the pivot ends of the leg bars so the leg bars extend a distance from the seat and are disposed generally near each other in a rest position of the leg bars, said means being adapted for moving the terminating ends generally away from each other in a general arc generally about the pivot ends to stretch positions;

a pair of leg decks, each leg deck being adapted for supporting a portion of one of the individual's legs; and a pair of slide assemblies, each slide assembly slidingly connecting one of the leg decks to one of the leg bars for sliding movement generally between the pivot end and the terminating end to permit adjustments for different leg lengths of individuals, each slide assembly pivotingly connecting one of the leg decks to one of the leg bars for permitting angular adjustment of the leg decks to accommodate the angles the individual's legs extend from the individual's body in the sitting position, each slide assembly comprising:

a channel slidingly connectable to one of the leg bars; and a pivot pin having opposite ends with one end connected to the channel and the pivot pin extending a distance from the channel; and wherein each of the leg decks includes a pivot opening sized and positioned to receive a portion of one of the pivot pins for cooperating to pivotingly connect each of the leg decks to one of the leg bars.

2. The stretching machine of claim 1 wherein each leg deck is defined further to include:

a rod having one end connected to the leg deck and the rod extending a distance from the leg deck, the pivot opening for accommodating one of the pivot pins disposed through a portion of the rod.

3. The stretching machine of claim 1 wherein each leg deck is defined further to include:

thigh pad means for engaging a portion of the inside thigh area of an individual; and calf pad means for engaging a portion of the inside calf area of the individual, the thigh pad means being spaced a distance from the calf pad means so the individual's knee area is disposed generally between the thigh pad means and the calf pad means.

4. The stretching machine of claim 1 wherein the means for moving the leg bars is defined further to include:

a hydraulic jack, comprising:

a jack base;

a base jack rod slidingly disposed in the jack base with an opening intersecting an upper end and extending a distance though the base jack rod terminating with a closed end; the base jack rod being moved out from the jack base when the hydraulic jack is actuated; and a connecting rod disposed in the opening in the base jack rod with one end of the connecting rod engaging the closed end in the base jack rod and the connecting rod extending a distance from the open end of the base jack rod terminating with an upper end; and a linkage for connecting the upper end of the connecting rod to the leg bars.

5. A stretching machine for stretching the legs of an individual comprising:

a seat adapted for accommodating the individual sitting thereon;

a pair of leg bars, each leg bar having a pivot end and an opposite terminating end;

means connected to the pivot ends of the leg bars so the leg bars extend a distance from the seat and are disposed generally near each other in a rest position of the leg bars, said means being adapted for moving the terminating ends generally away from each other in a general arc generally about the pivot ends to stretch positions, comprising:

a hydraulic jack, comprising:

a jack base;

a base jack rod slidingly disposed in the jack base with an opening intersecting an upper end and extending a distance though the base jack rod terminating with a closed end;

the base jack rod being moved out from the jack base when the hydraulic jack is actuated; and a connecting rod disposed in the opening in the base jack rod with one end of the connecting rod engaging the closed end in the base jack rod and the connecting rod extending a distance from the open end of the base jack rod terminating with an upper end; and a linkage for connecting the upper end of the connecting rod to the leg bars.

6. A stretching machine for stretching the legs of an individual, comprising:

a seat adapted for accommodating the individual sitting thereon;

a pair of leg bars, each leg bar having a pivot end and an opposite terminating end;

means connected to the pivot ends of the leg bars so the leg bars extend a distance from the seat and are disposed generally near each other in a rest position of the leg bars, said means being adapted for moving the terminating ends generally away from each other in a general arc generally about the pivot ends to stretch positions, comprising:

a hydraulic jack, comprising:

a jack base;

a base jack rod slidingly disposed in the jack base with an opening intersecting an upper end and extending a distance through the base jack rod terminating with a closed end; the jack base rod being moved out from the jack base when the hydraulic jack is actuated; and a connecting rod disposed in the opening in the opening in the base jack rod with one end of the connecting rod engaging the closed end in the base jack rod and the connecting rod extending a distance from the open end of the base jack rod terminating with an upper end;

a linkage for connection the upper end of the connecting rod to the leg bars a pair of leg decks, each leg deck being adapted for supporting a portion of one of the individual's legs; and a pair of slide assemblies, each slide assembly slidingly connecting one of the leg decks to one of the leg bars for sliding movement generally between the pivot end and the terminating end to permit adjustments for different leg lengths of individuals.

* * * * *